US009260121B2

(12) United States Patent
Jung

(10) Patent No.: US 9,260,121 B2
(45) Date of Patent: Feb. 16, 2016

(54) METHOD FOR OPERATING A SWITCHING YARD AND CONTROL DEVICE FOR A SWITCHING YARD

(75) Inventor: Ingo Jung, Braunschweig (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/113,595

(22) PCT Filed: May 7, 2012

(86) PCT No.: PCT/EP2012/058365

§ 371 (c)(1), (2), (4) Date: Oct. 24, 2013

(87) PCT Pub. No.: WO2012/152752

PCT Pub. Date: Nov. 15, 2012

(65) Prior Publication Data

US 2014/0042278 A1 Feb. 13, 2014

(30) Foreign Application Priority Data

May 11, 2011 (DE) ..... 10 2011 075 642

(51) Int. Cl.

| | |
|---|---|
| ***B61L 17/02*** | (2006.01) |
| ***B61L 17/00*** | (2006.01) |
| ***B61L 1/18*** | (2006.01) |
| ***B61L 23/24*** | (2006.01) |

(52) U.S. Cl.

CPC . *B61L 17/02* (2013.01); *B61L 1/18* (2013.01); *B61L 17/00* (2013.01); *B61L 23/24* (2013.01)

(58) Field of Classification Search

CPC ..... B61L 17/02; B61L 1/18; B61L 23/24; B61L 17/00

USPC ..... 701/20; 246/122

See application file for complete search history.

(56) References Cited

U.S. PATENT DOCUMENTS

| | | | | |
|---|---|---|---|---|
| 3,641,338 | A * | 2/1972 | Peel et al. | 246/1 R |
| 5,621,417 | A * | 4/1997 | Hassan et al. | 342/457 |
| 5,758,848 | A | 6/1998 | Beule | |
| 5,803,411 | A * | 9/1998 | Ackerman et al. | 246/169 R |
| 6,490,523 | B2 * | 12/2002 | Doner | 701/482 |
| 2003/0182030 | A1 * | 9/2003 | Kraeling et al. | 701/19 |

FOREIGN PATENT DOCUMENTS

| | | |
|---|---|---|
| DE | 757812 | 12/1953 |
| DE | 3127672 A1 | 1/1983 |
| DE | 260038 A1 | 9/1988 |

(Continued)

*Primary Examiner* — Fadey Jabr
*Assistant Examiner* — Yazan A Soofi
(74) *Attorney, Agent, or Firm* — Laurence Greenberg; Werner Stemer; Ralph Locher

(57) ABSTRACT

A particularly efficient method for operating a switching yard includes determining a position of a locomotive on an inbound track of the switching yard, determining a position of a front end of a unit to be divided facing a hump of the switching yard relative to a unit to be divided to be pushed by the locomotive from the inbound track to the hump, determining a distance between the locomotive and the front end of the unit to be divided on the basis of the determined positions, and comparing the determined distance to a reference value for the length of the unit to be divided. A control device for a switching yard is also provided.

14 Claims, 1 Drawing Sheet

(56) References Cited

FOREIGN PATENT DOCUMENTS

| | | | |
|---|---|---|---|
| DE | 4305514 | A1 | 8/1994 |
| DE | 19529919 | A1 | 2/1996 |
| DE | 10123433 | A1 | 8/2002 |
| DE | 10220873 | A1 | 11/2002 |
| DE | 10214224 | A1 | 10/2003 |
| DE | 102004057545 | A1 | 6/2006 |
| GB | 1191998 | * | 5/1970 |
| SU | 1104043 | A1 | 7/1984 |
| SU | 1682228 | A1 | 10/1991 |

* cited by examiner

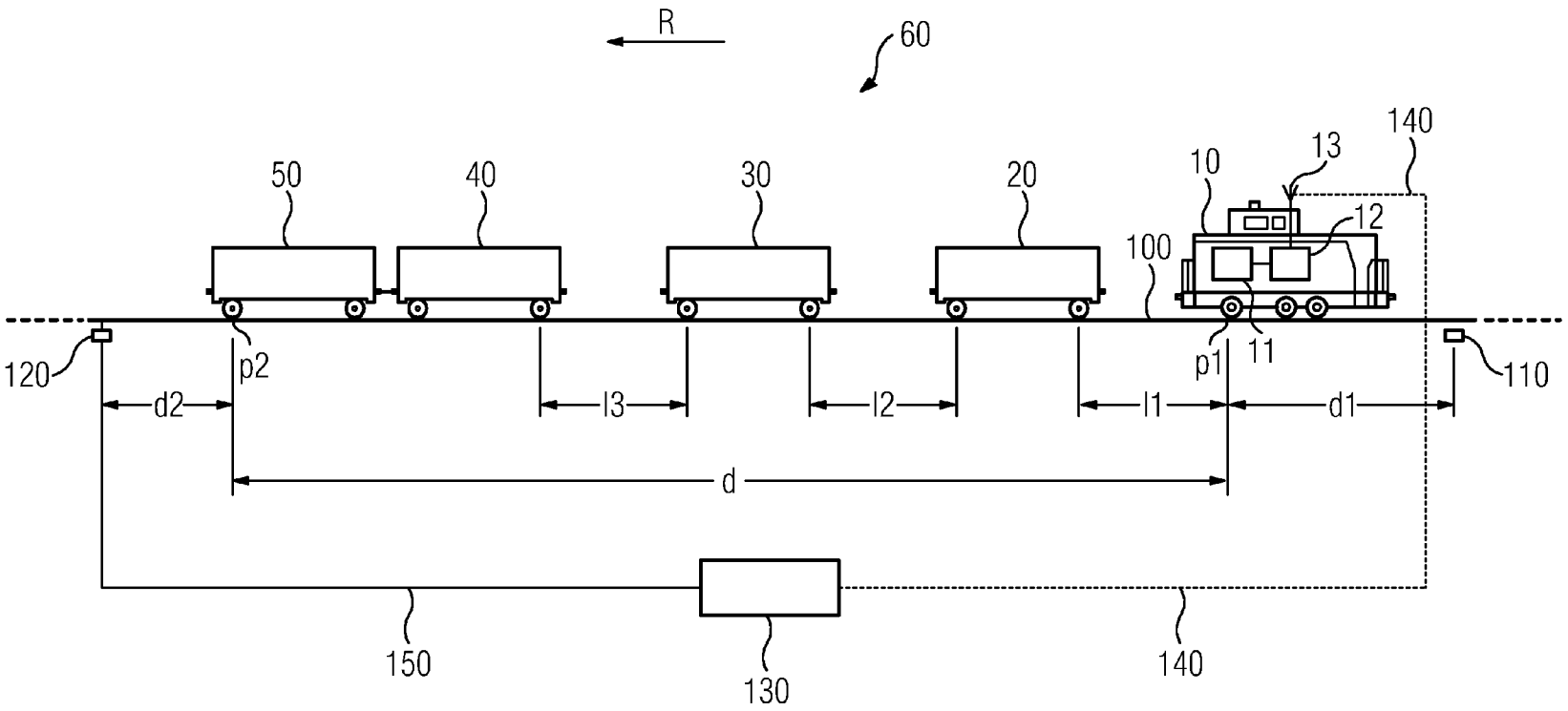
60
R
10
13
12
140
100
11
p1
110
d1
l1
20
l2
30
l3
40
50
p2
d2
d
120
130
150
140

METHOD FOR OPERATING A SWITCHING YARD AND CONTROL DEVICE FOR A SWITCHING YARD

BACKGROUND OF THE INVENTION

Field of the Invention

In automated switching yards, units to be divided in the form of incoming freight trains are normally uncoupled or readied for uncoupling on an inbound track of a reception yard in accordance with a cut list and subsequently pushed over a switching hump by a locomotive. As a result of appropriate hump control it is hereby made possible to build new trains in the destination tracks connecting to the switching hump from the individual humped cars or blocks of cars, which are also referred to as cuts.

In the interest of a speedy transportation of the cars or the goods carried it is desirable for the cars to spend as short a time as possible in a switching yard and in conjunction therewith for the yard to operate at the greatest possible level of efficiency. On the other hand, the opportunities for further performance optimization in modern automatic switching yards are limited by the fact that accidents or damage to the switched cars or their loads, for example as a result of unacceptably strong impact jolts of the cars among one another, must also be reliably avoided under unfavorable operational conditions.

BRIEF SUMMARY OF THE INVENTION

The object of the present invention is to specify a method for operating a switching yard which enables an increase in the efficiency of the yard without compromising the quality of the switching.

This object is achieved according to the invention by a method for operating a switching yard, wherein the position of a locomotive on an inbound track of the switching yard is determined, the position of the front end of the unit to be divided facing the switching hump is determined relative to a unit to be divided which is to be pushed by the locomotive from the inbound track to a switching hump of the switching yard, the distance between the locomotive and the front end of the unit to be divided is determined on the basis of the determined positions, and the determined distance is compared with a reference value for the length of the unit to be divided.

It should be noted that the first and the second step of the method according to the invention, in other words the determination of the position of the locomotive or of the front end of the unit to be divided can also be performed in reverse order or also simultaneously.

The method according to the invention is based on the awareness that in the region of the inbound track a knowledge of "gaps" between the locomotive and the front end of the unit to be divided facing the switching hump which is to be pushed by the locomotive from the inbound track to the switching hump of the switching yard enables an improvement in the operational procedures and associated therewith an improvement in the efficiency of the switching yard. Corresponding gaps can generally arise on the one hand in the context of uncoupling the units to be divided; on the other hand it is also possible that (temporary) gap formation occurs only during the advancement operation, in other words while the unit to be divided is being pushed by the locomotive from the inbound track toward the switching hump. This is caused in particular by impacts between the individual cars or blocks of cars of the unit to be divided and also differing running characteristics of the cars or blocks of cars.

A determination as to whether or not corresponding gaps are present and how large said gaps are in total where applicable is performed according to the invention in that the distance between the locomotive and the front end of the unit to be divided is determined and subsequently compared with a reference value for the length of the unit to be divided. By preference the distance determined between the locomotive and the front end of the unit to be divided corresponds in this case within measurement tolerances to the reference value for the situation in which there are no gaps within the unit to be divided and the locomotive has moved up completely to the rear end of the unit to be divided. In this situation, depending on the respective concrete realization, in other words in particular on the manner in which the position of the locomotive and also the position of the front end of the unit to be divided are determined, corrections may be applied where applicable, such as for taking buffer overhangs into consideration.

A train length made available or previously notified by a scheduling system of the switching yard can for example be used as the reference value for the length of the unit to be divided. Alternatively, it is however basically also conceivable that the length of the unit to be divided is for example measured upon entry of the still coupled unit to be divided into the inbound track and the corresponding measurement value is subsequently used as the reference value for the length of the unit to be divided.

The knowledge obtained by the method according to the invention relating to the presence or absence of gaps can on the one hand be used in order to optimize the pushing together of the unit to be divided, as a result whereof impact jolts between the individual cars or blocks of cars of the unit to be divided can advantageously be avoided or reduced. On the other hand, in the event that the comparison yields the result that no gaps are (any longer) present an increased approach speed toward the switching hump is possible for the locomotive and thereby for the unit to be divided.

The method according to the invention can already be performed as the locomotive approaches the unit to be divided or also while the locomotive and also the unit to be divided are approaching the switching hump. By preference the method according to the invention is performed continuously or cyclically here in order to also enable detection of changes in the distance between the locomotive and the front end of the unit to be divided. This means that it is possible on the one hand to ascertain that gaps which may be present initially within the unit to be divided have closed during the further course of events. In addition, this does however also mean that it is possible to detect the situation where starting from a gap-free or gapless state gaps arise within the unit to be divided or between the unit to be divided and the locomotive during the course of the further switching activity.

The overall result achieved by this means is thus an increase in the efficiency of the switching yard to the effect that the time required in order to advance the unit to be divided from the inbound track onto the hump track or to the switching hump can be reduced. This is advantageously done whilst maintaining or where appropriate even improving the quality of switching to the effect that by taking into consideration gaps within the unit to be divided or between the unit to be divided and the locomotive impact jolts can be avoided or reduced with regard to their strength and/or number.

Furthermore, the method according to the invention has the advantage that comparatively few measuring devices are required in the region of the inbound track in order to implement the method. The reason for this is that the comparison of the distance between the locomotive and the front end of the unit to be divided with the reference value for the length of the unit to be divided enables a general statement regarding whether or not there are gaps between the individual cars or blocks of cars of the unit to be divided or between the unit to be divided and the locomotive.

By preference the method according to the invention can be developed in such a manner that a control signal is generated for the locomotive by taking into consideration the result of the comparison. By means of the control signal it is advantageously possible in this case, on the basis of the result of the comparison of the distance between the locomotive and the front end of the unit to be divided with the reference value for the length of the unit to be divided, to indirectly or directly influence the driving behavior of the locomotive.

In accordance with a further particularly preferred embodiment of the method according to the invention the speed of the locomotive is controlled in this case by means of the control signal. This means that in particular in the case of automatically controlled locomotives it is possible to directly influence the speed of the locomotive by means of the control signal. In this situation the speed of the locomotive can for example be increased if the comparison of the determined distance with the reference value for the length of the unit to be divided yields the result that there are no gaps present either between the locomotive and the unit to be divided or within the unit to be divided.

In addition or as an alternative to the aforementioned preferred development the method according to the invention can advantageously also be implemented in such a manner that the control signal is output on a display device. This is advantageous in particular for those cases in which the locomotive is controlled entirely or partially by switchmen. By outputting the control signal on the display device it is for example possible to output information about the result of the comparison of the determined distance with the reference value for the length of the unit to be divided. In addition or as an alternative thereto, it is for example also possible to display a recommendation with regard to an increase or reduction in the speed of the locomotive.

It should be noted that the display device can be arranged in or on the locomotive. In this case it is thereby possible by means of the control signal or the output thereof to convey information to a switchman located on the locomotive. As an alternative thereto, it is however also conceivable that the locomotive is controlled by means of a remote control facility arranged outside the locomotive and the display device is designed as part of the remote control device or as a supplementary component for said remote control facility.

In the context of the method according to the invention the determination of the position of the locomotive can basically take place in any desired already known manner.

By preference the method according to the invention is developed in such a manner that the position of the locomotive is determined relative to a reference position, in particular in the form of the position of a balise. This offers the advantage that by determining the position of the locomotive relative to a reference position it is possible carry out an exact position determination in a comparatively simple manner, in which case in particular the need for an absolute position determination is avoided. It is therefore conceivable for example that the position of the locomotive is determined by using a track free length measurement to determine the distance between the locomotive and an insulated rail joint or a corresponding measuring device on the track. In this situation the known position of an insulated rail joint thereby serves as a reference position.

The use of the position of a balise as a reference position is regarded as particularly advantageous because corresponding balises are often already disposed in the region of the inbound tracks of switching yards. Because the position of the balise on the track is known and constant it can be used as a reference position for determining the position of the locomotive. Locomotives thus generally provide distance meter readings on a continuous basis, which can be acquired for example by means of distance meter pulse generators, from which the position of the locomotive on the inbound track can be determined taking into consideration the distance meter reading on reaching the balise and also the known position of the balise.

Different forms of embodiment can also be realized in the context of the method according to the invention in respect of the determination of the position of the front end of the unit to be divided. The determination of said position could thus take place for example in radar-based fashion depending on the particular circumstances.

In accordance with a further particularly preferred embodiment the method according to the invention is designed in such a manner that the position of the front end of the unit to be divided is determined by using a track free length measurement to determine the distance between the frontmost axle of the unit to be divided facing the switching hump and an insulated rail joint. This is advantageous because it means that a determination of the position of the front end of the unit to be divided is possible in a comparatively simple, already known manner. By preference the insulated rail joint or the associated measuring device is in this case provided on the respective inbound track prior to the first junction switch of a reception yard having a plurality of inbound tracks. Methods for track free length measurement are known for example from the German patent applications DE 31 27 672 A1, DE 43 05 514 A1 and DE 101 23 433 A1.

By preference the method according to the invention can also be designed in such a manner that the distance between the locomotive and the rear end of the unit to be divided facing away from the switching hump is additionally determined. In this situation a corresponding distance determination can be performed for example by means of a sensor device arranged on the locomotive in accordance with already known methods. By using an additional determination of the distance between the locomotive and the rear end of the unit to be divided facing away from the switching hump it is advantageously possible to obtain a statement as to the extent to which possible gaps affect the unit to be divided itself or else the region between the locomotive and the unit to be divided. By this means it is for example already possible to obtain reliable information as to whether or not the unit to be divided itself contains gaps as the locomotive approaches the unit to be divided.

The invention furthermore relates to a control device for a switching yard.

With regard to the control device, the object of the present invention is to specify a control device for a switching yard which enables an increase in the efficiency of the yard without compromising the quality of the switching.

This object is achieved according to the invention by a control device for a switching yard, having a first measuring device for determining the position of a locomotive on an inbound track of the switching yard, a second measuring device which is designed for determining the position of the front end of the unit to be divided facing the switching hump relative to a unit to be divided to be pushed by the locomotive from the inbound track to a switching hump of the switching yard, and an evaluation device for determining the distance between the locomotive and the front end of the unit to be divided on the basis of the determined positions and also for comparing the determined distance with a reference value for the length of the unit to be divided.

The advantages of the control device according to the invention correspond to those of the method according to the invention such that the corresponding foregoing descriptions should be referred to in this regard. The same applies in respect of the preferred developments of the control device stated in the following in relation to the corresponding preferred developments of the method according to the invention such that the respective foregoing descriptions should also be referred to in this regard.

By preference the control device according to the invention can be embodied in such a manner that the evaluation device is designed to generate a control signal for the locomotive taking into consideration the result of the comparison.

In accordance with a particularly preferred development the control device according to the invention is designed in such a manner that the speed of the locomotive is controlled by means of the control signal.

By preference the control device according to the invention can also be implemented in such a manner that the control device is designed to output the control signal on a display device.

In accordance with a further particularly preferred embodiment of the control device according to the invention the first measuring device is designed for determining the position of the locomotive relative to a reference position, in particular in the form of the position of a balise.

By preference the control device according to the invention can also be developed in such a manner that the second measuring device is designed such that the position of the front end of the unit to be divided is determined by using a track free length measurement to determine the distance between the frontmost axle of the unit to be divided facing the switching hump and an insulated rail joint.

In accordance with a further particularly preferred embodiment the control device according to the invention is additionally designed in order to determine the distance between the locomotive and the rear end of the unit to be divided facing away from the switching hump.

BRIEF DESCRIPTION OF THE SINGLE VIEW OF THE DRAWING

The invention will be described in detail in the following with reference to an exemplary embodiment. To this end, the FIGURE shows a schematic diagram with an exemplary embodiment of the control device according to the invention by way of explanation of an exemplary embodiment of the method according to the invention.

DESCRIPTION OF THE INVENTION

A locomotive 10 in the form of a switcher locomotive can be seen in the FIGURE. The locomotive 10 is located on an inbound track 100 of a switching yard together with freight cars 20 and 30 and also a car group consisting of two coupled freight cars 40 and 50. The freight cars 20, 30, 40 and 50 together form a unit to be divided 60 which is to be pushed by the locomotive 10 from the inbound track 100 in a switching direction R indicated by an arrow to a switching hump of the switching yard. The objective in this case is to assemble the freight cars 20, 30, 40, 50 of the unit to be divided 60 to build new trains by means of the switching yard or the humpyard thereof.

A gap 11 can be seen between the locomotive 10 and the freight car 20 in the FIGURE. Furthermore, there are also gaps 12 and 13 within the unit to be divided 60. In order to be able to take corresponding gaps 11, 12, 13 into consideration and avoid impact jolts between the freight cars 20, 30, 40 and 50 of the unit to be divided 60 in the context of the locomotive 10 approaching the unit to be divided 60 and also in the context of the locomotive 10 and also of the unit to be divided 60 advancing to the switching hump in particular with regard to the speed control of the locomotive 10, in the context of the described method the distance d between the locomotive 10 and the front end of the unit to be divided 60 facing the switching hump, in other words the front end of the freight car 50 in the switching direction R, is determined.

In the context of the exemplary embodiment described, to this end the position of the locomotive 10 on the inbound track 100 of the switching yard is determined relative to a reference position in the form of the position of a balise 110. On the part of the locomotive 10 this is done by detection of passing over the balise 110 and on the basis of said known reference position the respective distance d1 to the balise 110 and thereby the respective position p1 of the locomotive 10 on the inbound track 100 is determined by means of a distance meter, in other words for example a tachometer. By preference the locomotive 10 continuously or cyclically provides distance meter readings in this case, from which the position p1 of the locomotive 10 on the inbound track 100 can be determined by taking into consideration the distance meter reading on passing over the balise 110.

The position p1 of the locomotive 10 determined in such manner by an on-board first measuring device 11, which in accordance with the foregoing descriptions can for example comprise a distance meter or distance meter pulse generator, is conveyed by the first measuring device 11 to an on-board transmission device 12 and is transmitted by the latter in radio-based fashion using an on-board antenna 13 by way of a wireless communication link 140 to an evaluation device 130 of a control device of the switching yard.

In a further method step the position p2 of the front end of the unit to be divided 60 facing the switching hump is now determined. This can be done for example in such a manner that the distance between the frontmost axle of the unit to be divided 60 facing the switching hump and an insulated rail joint or a second measuring device 120 is determined by using a track free length measurement. The determination of said distance d2 makes it possible by taking into consideration the known position of the insulated rail joint or of the second measuring device 120 to precisely determine the position p2 of the front end of the unit to be divided 60 with comparatively little effort. The corresponding measurement result is conveyed by the second measuring device 120 by way of a wired communication link 150 likewise to the evaluation device 130.

From the positions p1 and p2 received the evaluation device 130 determines the distance d between the locomotive 10 and the front end of the unit to be divided 60. By means of a comparison of the determined distance d with a reference value taken for example from a notification by a scheduling system it is possible in this case for the evaluation device 130 to make a statement as to whether or not there are gaps between the locomotive 10 and the front end of the unit to be divided 60. If a measurement of the distance 11 between the locomotive 10 and the rear end of the unit to be divided 60, in other words the end of the car 20 facing the locomotive 10, is additionally performed, a statement as to how large the gap or the gaps is/are within the unit to be divided 60 itself is moreover possible.

It should be noted at this point that with regard to the determination of the positions and distances in the context of the described method corrections can be carried out depending on the measurement methods applied in each case. With regard to the position p1 of the locomotive 10, this applies for example in relation to the position at which an on-board detection device for detecting the balise 110 is arranged on the locomotive 10, or also in relation to a known distance of a leading edge of the buffers of the locomotive from the first axle of said locomotive, in other words in relation to the so-called overhang. The same also applies accordingly in respect of the determination of the position p2 of the front end of the unit to be divided 60 facing the switching hump.

In accordance with the foregoing explanations, the described exemplary embodiment of the method according to the invention and of the control device according to the invention, which in addition to the evaluation device 130 in particular comprises the first measuring device 11 and also the second measuring device 120, advantageously enables an optimization of the operation of the switching yard. Thus, on the one hand, with an awareness of gaps 12, 13 within the unit to be divided 60 or with the knowledge that no corresponding gaps are present an increased approach speed of the locomotive 10 and also of the unit to be divided 60 toward the switching hump is possible. It is moreover possible to optimize the pushing together of the unit to be divided 60 whilst at the same time avoiding impact jolts between the freight cars 20, 30, 40, 50 of the unit to be divided 60. As a result, an increase in the efficiency of the switching yard is thereby enabled through accelerated switching in the region of the inbound track 100, in which case an adverse effect on the quality of switching—in the form of an increase in the number or strength of impact jolts for example—is advantageously avoided at the same time.

The invention claimed is:

1. A method for operating a switching yard, the method comprising the following steps:

determining a position of a locomotive on an inbound track of the switching yard;

determining a position of a front end of a unit to be divided facing a hump of the switching yard, for a unit to be divided to be pushed by the locomotive from the inbound track to the hump;

using an evaluation device for:

determining a distance between the locomotive and the front end of the unit to be divided on a basis of the determined positions;

comparing the determined distance with a reference value for a length of the unit to be divided; and generating a control signal for the locomotive by taking a result of the comparing step into consideration.

2. The method according to claim 1, which further comprises controlling a speed of the locomotive by using the control signal.

3. The method according to claim 1, which further comprises outputting the control signal on a display device.

4. The method according to claim 1, which further comprises carrying out the step of determining the position of the locomotive relative to a reference position.

5. The method according to claim 4, wherein the reference position is a position of a balise.

6. The method according to claim 1, which further comprises carrying out the step of determining the position of the front end of the unit to be divided by using a track-free length measurement to determine a distance between a front-most axle of the unit to be divided facing the hump and an insulated rail joint.

7. The method according to claim 1, which further comprises additionally determining a distance between the locomotive and a rear end of the unit to be divided facing away from the hump.

8. A control device for a switching yard, the control device comprising:

a first measuring device configured to determine a position of a locomotive on an inbound track of the switching yard;

a second measuring device configured to determine a position of a front end of a unit to be divided facing a hump of the switching yard, for a unit to be divided to be pushed by the locomotive from the inbound track to the hump; and an evaluation device:

configured to determine a distance between the locomotive and the front end of the unit to be divided on a basis of the determined positions;

configured to compare the determined distance with a reference value for a length of the unit to be divided; and configured to generate a control signal for the locomotive by taking a result of the comparison into consideration.

9. The control device according to claim 8, wherein a speed of the locomotive is controlled by using said control signal.

10. The control device according to claim 8, which further comprises a display device configured to display said control signal.

11. The control device according to claim 8, wherein said first measuring device is configured to determine said position of the locomotive relative to a reference position.

12. The control device according to claim 11, wherein said reference position is a position of a balise.

13. The control device according to claim 8, wherein said second measuring device is configured to determine the position of the front end of the unit to be divided by using a track free-length measurement to determine a distance between a front-most axle of the unit to be divided facing the hump and an insulated rail joint.

14. The control device according to claim 8, wherein the control device is additionally configured to determine a distance between the locomotive and a rear end of the unit to be divided facing away from the hump.

* * * * *